United States Patent [19]

Diebel

[11] 4,064,888

[45] Dec. 27, 1977

[54] VENT STRUCTURE FOR DISHWASHERS

[75] Inventor: Howard Diebel, St. Catharines, Canada

[73] Assignee: Moyer Diebel Limited, Jordan Station, Canada

[21] Appl. No.: 766,359

[22] Filed: Feb. 7, 1977

[51] Int. Cl.[2] ..... B08B 3/02

[52] U.S. Cl. ..... 134/182; 134/200; 34/235; 312/214

[58] Field of Search ..... 134/56 D, 57 D, 58 D, 134/104, 182, 200; 34/65, 235; 68/18 R; 312/213, 214

[56] References Cited

U.S. PATENT DOCUMENTS

| | | | |
|---|---|---|---|
| 2,674,249 | 4/1954 | Knight | 134/56 D |
| 2,871,082 | 1/1959 | Karig et al. | 134/182 X |
| 3,117,582 | 1/1964 | Perl | 134/182 X |
| 3,356,431 | 12/1967 | Martiniak | 312/213 |
| 3,387,388 | 6/1968 | Williamson | 134/200 X |
| 3,439,688 | 4/1969 | Sholtes | 134/104 |
| 3,982,552 | 9/1976 | Fraula | 134/57 D |

*Primary Examiner*—Robert L. Bleutge
*Attorney, Agent, or Firm*—Hirons & Rogers

[57] ABSTRACT

A dishwasher of the batch type is provided with vent means to atmosphere to relieve pressure build-up in its interior. The vent means consist of a vent structure disposed to one side of a front-opening door, preferably one on either side, this structure providing a horizontal vent passage that intersects a vertical drain passage leading to the dishwasher sump. The structure is formed by three elongated members of various shapes, that fit together to provide two separate drain channels of the drain passage, and that also provide a channel receiving and supporting the door side sealing gaskets.

6 Claims, 3 Drawing Figures

VENT STRUCTURE FOR DISHWASHERS

FIELD OF THE INVENTION

The present invention is concerned with improvements in or relating to dishwashers and especially, but not exclusively, to automatic dishwashers of the "batch" type as employed in commercial establishments.

REVIEW OF THE PRIOR ART

All domestic dishwashers, and most commercial installations, are of what can be called the "batch" type, in which a tray of dishes is inserted in the machine, the door is closed, and very hot water is sprayed violently on to the dishes to clean and rinse them. The door must be provided with edge seals to prevent escape of the hot water and the vapour generated by its violent agitation. At the start of the operation on a new batch of dishes the relatively cool air in the dishwasher interior is heated rapidly by the hot water, and some form of vent must be provided to the exterior to prevent a dangerous increase of internal pressure, and the consequent possibility of a dangerous outrush of hot vapour as the door is opened. The provision of such a vent has proven unexpectedly difficult, and the most usual solution appears to be to provide it by means of apertures in the door handle. Some of the escaping vapour condenses upon encountering the outside air and the resultant drips fall on to the floor, besides leaving unsightly marks on the front of the cabinet.

DEFINITION OF THE INVENTION

It is therefore a principal object of the invention to provide a new vent structure for dishwashers of the batch type.

In accordance with the invention there is provided a dishwasher of the batch type comprising a body providing an enclosure, water spray means mounted in the enclosure for spraying water on to dishes placed therein, a sump within the enclosure receiving liquid that drains thereto, a door for the enclosure pivotably mounted to the body and movable between open and closed positions, seal means mounted around the said body opening and engaged by the door in closed position for sealing the junction between the body and the door, and vent means comprising a vent structure mounted to the body to one side of the door, the said vent structure providing at least one labyrinth vent passage connecting the body interior and the ambient atmosphere through which gas and vapour from the body interior can pass with change of direction of flow so as to promote contact thereof with the walls of the vent passage, and the vent structure also providing at least one vertical drain passage connecting the vent passage and the sump and having passage walls in common with the vent passage whereby moisture condensing on the said walls drains down to the said sump.

DESCRIPTION OF THE DRAWINGS

A dishwasher that is a particular preferred embodiment of the invention will now be described, by way of example, with reference to the accompanying diagrammatic drawings wherein.

DESCRIPTION OF THE PREFERRED EMBODIMENTS

Figure 1:
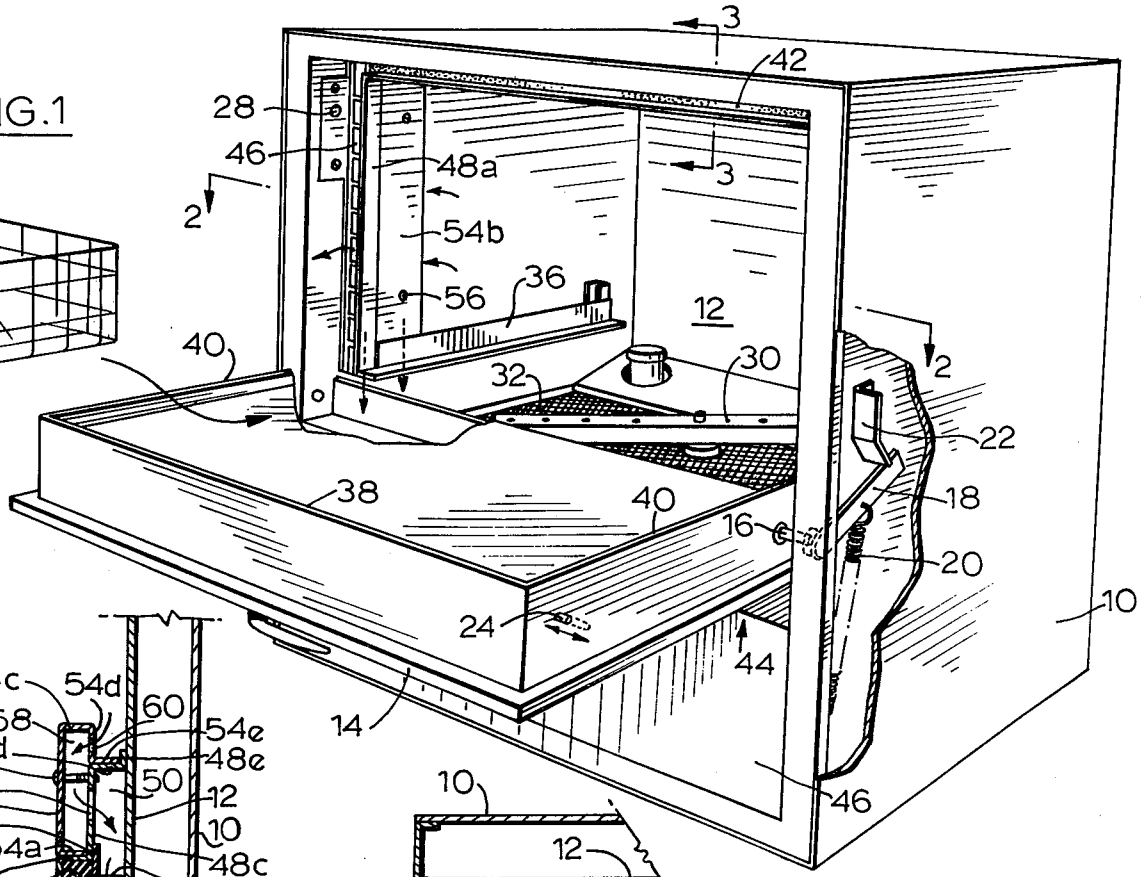
FIG. 1 is a perspective view from the front and to one side with the door shown open, and with a part shown broken away for clarity of illustration.

The dishwasher body is of rectangular shape comprising spaced outer and inner metal casings 10 and 12 respectively, the space between the casings being filled with suitable heat-insulating material (not shown). The enclosure provided by the body is open to the front and is closed by a door 14 mounted by pivot pins 16 to move between horizontal open and vertical closed positions. Each pin 16 (only one shown) carries a lever arm 18 to which counterweight spring 20 is fastened, and which engages a stop 22 to determine the horizontal fully-open position of the door. The door is locked in its closed position by bolts 24 which are operated by handle 26 and are engageable in recesses 28.

The lower part of the body mounts a horizontal rotating spray arm 30, by which washing and rinsing water is sprayed on to the dishes, and contains the pump, piping, valves, control mechanism, etc., that are required for operation of the dishwasher; these items form no part of the present invention, and are known to those skilled in the art, so that further description is not considered necessary. The floor of the enclosure is constituted by a screen 32 through which the liquid draining from the enclosure passes to a sump in the body lower part. Dishes to be washed are mounted in a wire tray 34, which can be placed on the inner face of the door 14 while in its horizontal open position and then slid into the enclosure on horizontal slide guides 36.

The door 14 is formed with protruding inner edges 38 and 40 along respectively its top and sides, which edges engage respective resilient edge seal means 42 mounted around the enclosure opening so as to seal the respective junctions between the door and the body when the door is closed. The lower edge of the door in closed position presses against a flat seal member 44 mounted on the inner side of body partition 46 to close the corresponding junction.

In operation a laden tray 34 is slid into the enclosure, the door 14 is closed and locked by rotating the handle 26, and a washing cycle is started. The hot water sprayed into the enclosure by the spray arm 30 causes an immediate violent expansion of the relatively cool air in the enclosure; in addition the violent agitation of the hot liquid causes the generation of vapour therefrom. The pressure in the enclosure rises rapidly above the ambient outside pressure, and must be relieved by venting to the outside atmosphere. Vent means in accordance with the invention consists of at least one vent structure (and preferably two as in the preferred embodiment) disposed to one side of the door, between the door edge and the inner surface of the respective body side wall. Each vent structure provides a horizontally-extending labyrinth vent passage which connects the interior to the ambient atmosphere, together with a vertically-extending drain passage which intersects the vent passage and drains any liquid condensing therein to the dishwasher sump. To this end the two passages have as many walls as possible in common, and the labyrinth vent passage causes a number of changes in flow direction, so as to cause impingement of the escaping vapour against these walls to facilitate condensation thereon.

In this embodiment each such vent structure comprises a front Z-section member 44 having legs **44*a* and 44*c* and intervening web 44*b*. Leg 44*a* is fastened to the inside surface of the inner casing 12 so as to extend vertically, and web 44***b* is provided with a large number of discharge apertures 46, through which the vapour, etc. escapes to the ambient atmosphere, as indicated by the arrows. A flanged Z-section member 48 has legs 48*b* and 48*d* connected by web 48*c*, leg 48*b* carring flange 48*a*, while leg 48*d* carries flange 48*e*. Web 48*c* is fastened to leg 44*c*, while the flange 48*c* is fastened to the inside wall of inside casing 12, thereby forming a vertically-extending drain channel 50 between itself and the member 44. The central web 48*c* is provided with a large number of openings 52 for the passage of vapour. Another member 54 of what will be called channel-L-flanged-section has legs 54*a* and 54*c* on either side of base 54*b*, the leg 54*b* having integral therewith an L-shaped flange having arms 54*d* and 54*e*. This member is fastened in place by means of screws 56 to complete the vent and drain passages, forming another vertically-extending drain channel 58 between itself and the member 48. Thus the arm 54*e* abuts against arm 48*d* and flange 48*e*, while leg 54*a* abuts against leg 48*b* and web 48*c*, the arm 54*d* being provided with a large number of openings 60.

Figure 2:
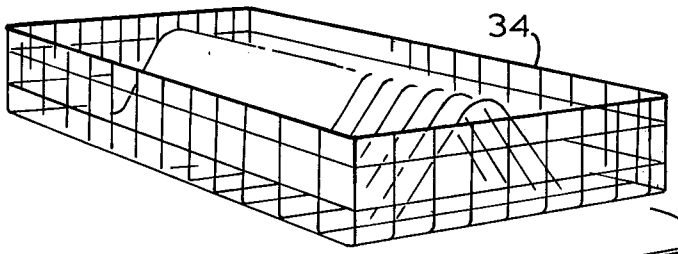
FIG. 2 is a section on the line 2—2 of FIG. 1.
Figure 2:
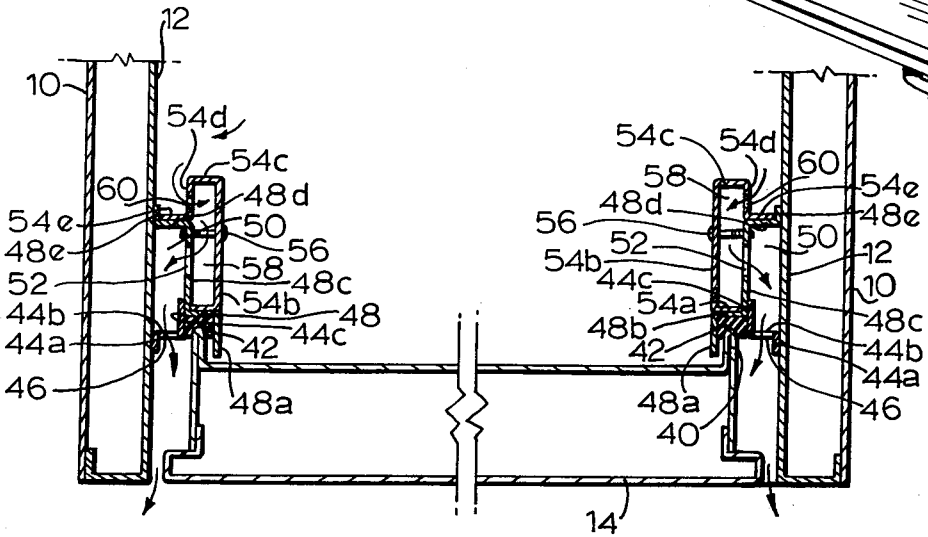
Figure 3:
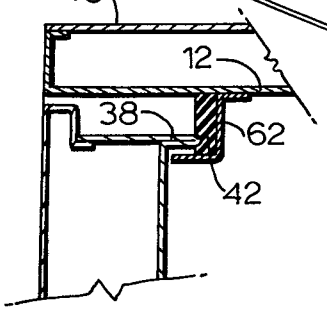
FIG. 3 is a section on the line 3—3 of FIG. 1.

It will be seen that the gas/vapour mixture from the interior passes in the vent passages through apertures 60 into passage 58 and with changes of direction through apertures 52 into passage 50; after another change of direction it passes through apertures 46 to the ambient atmosphere. During this passage it has a large member of opportunities for contact with the walls of the chambers, so as to condense and deposit moisture thereon for drainage to the sump. It will be observed from FIG. 2 that the final apertures 46 are deep within the dishwasher structure and an operator can safely stand in front of the apparatus with little possibility of being in the paths of the gas/vapour stream.

Legs 44*c* and 48*b* and flange 48*a* together form a channel which receives the side sealing gaskets 42, while a Z-shaped member 62 forms a similar channel for the upper gasket 42, thus permitting full and effective sealing of the door junctions while also providing adequate venting for the relatively large volumes of gases and vapours involved.

I claim:

1. A dishwasher of the batch type comprising a body providing an enclosure, water spray means mounted in the enclosure for spraying water on to dishes placed therein, a sump within the enclosure receiving liquid that drains thereto, a door for the enclosure pivotably mounted to the body and movable between open and closed positions, seal means mounted around the said body opening and engaged by the door in closed position for sealing the junction between the body and the door, vent means comprising a vent structure mounted to the body to one side of the door, the said vent structure providing at least one labyrinth vent passage connecting the body interior and the ambient atmosphere through which gas and vapour from the body interior can pass with change of direction of flow so as to promote contact thereof with the walls of the vent passage, and the vent structure also providing at least one vertical drain passage connecting the vent passage and the sump and having passage walls in common with the vent passage whereby moisture condensing on the said walls drains down to the said sump.

2. A dishwasher as claimed in claim 1, wherein the said vent means comprise a vent structure on each side of the door, each structure providing a respective labyrinth passage and a respective drain passage.

3. A dishwasher as claimed in claim 1, wherein the said vent structure provides a channel receiving a respective door side sealing gasket of the said seal means around the body opening.

4. A dishwasher as claimed in claim 1, wherein the said vent structure comprises two parallel drain channels constituting the vertical drain passage, one channel interior being connected to the dishwasher interior, the two channel interiors being connected to one another, and the second channel interior being connected to the ambient atmosphere.

5. A dishwasher as claimed in claim 1, wherein the vent structure comprises a first Z-section member and a second Z-section flanged member both fastened to the dishwasher inside wall and forming a first vertical drain channel between them, and a third member fastened to the second member and forming a second vertical drain channel between them, the labyrinth vent passage comprising apertures in the members for passage of gas and vapour therethrough.

6. A dishwasher as claimed in claim 5, wherein the said first and second members form between themselves a channel receiving a respective door side sealing gasket of the said seal means around the body opening.

* * * * *